US010980334B2

(12) United States Patent
Cho et al.

(10) Patent No.: US 10,980,334 B2
(45) Date of Patent: Apr. 20, 2021

(54) FINGER FITTING-TYPE MAKEUP TOOL

(71) Applicant: AMOREPACIFIC CORPORATION, Seoul (KR)

(72) Inventors: Yeon Ju Cho, Yongin-si (KR); Ji Jung Lee, Yongin-si (KR); Hae Won Jeong, Yongin-si (KR); Eun Sil Han, Yongin-si (KR); Hyun Woo Roh, Yongin-si (KR)

(73) Assignee: AMOREPACIFIC CORPORATION, Seoul (KR)

( * ) Notice: Subject to any disclaimer, the term of this patent is extended or adjusted under 35 U.S.C. 154(b) by 43 days.

(21) Appl. No.: 16/499,535

(22) PCT Filed: Apr. 2, 2018

(86) PCT No.: PCT/KR2018/003859
§ 371 (c)(1),
(2) Date: Sep. 30, 2019

(87) PCT Pub. No.: WO2018/182384
PCT Pub. Date: Oct. 4, 2018

(65) Prior Publication Data

US 2020/0022481 A1 Jan. 23, 2020

(30) Foreign Application Priority Data

Mar. 31, 2017 (KR) ..... 10-2017-0042055

(51) Int. Cl.
*A46B 11/00* (2006.01)
*A45D 40/26* (2006.01)
*A45D 33/26* (2006.01)

(52) U.S. Cl.
CPC ..... *A45D 40/267* (2013.01); *A45D 33/26* (2013.01); *A45D 40/262* (2013.01);
(Continued)

(58) Field of Classification Search
CPC ..... A45D 40/262; A45D 40/267; A46B 2200/1053
(Continued)

(56) References Cited

U.S. PATENT DOCUMENTS 8,662,091 B2 * 3/2014 Jang ..... A46B 5/04 132/320
10,413,040 B2 * 9/2019 Jeong ..... A45D 34/043
(Continued)

FOREIGN PATENT DOCUMENTS

JP 2010246854 A 11/2010
KR 2020090005979 U 6/2009
(Continued)

OTHER PUBLICATIONS

International Search Report for PCT/KR2018/003859 dated Jul. 16, 2018.
(Continued)

*Primary Examiner* — Jennifer C Chiang
(74) *Attorney, Agent, or Firm* — Cantor Colburn LLP

(57) ABSTRACT

A finger fitting-type makeup tool includes: a container where an eyelash cosmetic material is received and is open at an upper end thereof; an application unit coupled to the upper end allowing a user to fit their finger thereinto to apply the cosmetic material; and a middle unit for detachably coupling the application unit to the container. The application unit includes: a finger fitting part which provides a fitting space where a user can insert his/her finger from above; an outer tube which surrounds the circumference of the finger fitting part and is open at an upper side thereof; an elastic support part fixed to an inner surface of the finger fitting part; a stick extending downward from one point of the inner space of the
(Continued)

outer tube; and a brush arranged on an end portion of the stick to be usable for dipping and applying of the cosmetic material.

19 Claims, 7 Drawing Sheets

(52) U.S. Cl.
CPC .... *A45D 40/264* (2013.01); *A45D 2200/1072* (2013.01); *A46B 2200/1053* (2013.01)

(58) Field of Classification Search
USPC ..... 401/126, 7
See application file for complete search history.

(56) References Cited

U.S. PATENT DOCUMENTS 10,646,020 B2 * 5/2020 Jeong ..... A45D 40/264
10,729,229 B2 * 8/2020 Mouraret ..... B29C 64/20
10,881,187 B2 * 1/2021 Jeong ..... A45D 34/04
2019/0350341 A1 * 11/2019 Cho ..... A45D 40/264

FOREIGN PATENT DOCUMENTS

| | | | |
|---|---|---|---|
| KR | 2020110004519 | U | 5/2011 |
| KR | 200476610 | Y1 | 3/2015 |
| KR | 1020160107137 | A | 9/2016 |
| KR | 1020170005966 | A | 1/2017 |
| KR | 1020170005967 | A | 1/2017 |
| KR | 1020170005968 | A | 1/2017 |
| KR | 101862858 | B1 | 7/2018 |
| WO | 2017007173 | A1 | 1/2017 |

OTHER PUBLICATIONS

Korean Office Action for Application No. 10-2017-0042055 dated Feb. 28, 2018.
Written Opinion for PCT/KR/2018/003859 dated Jul. 16, 2018.
European Supplemental Partial Search Report for Application No. EP 18 77 6575 dated Dec. 1, 2020, citing the above reference(s).

* cited by examiner

【FIG. 1】
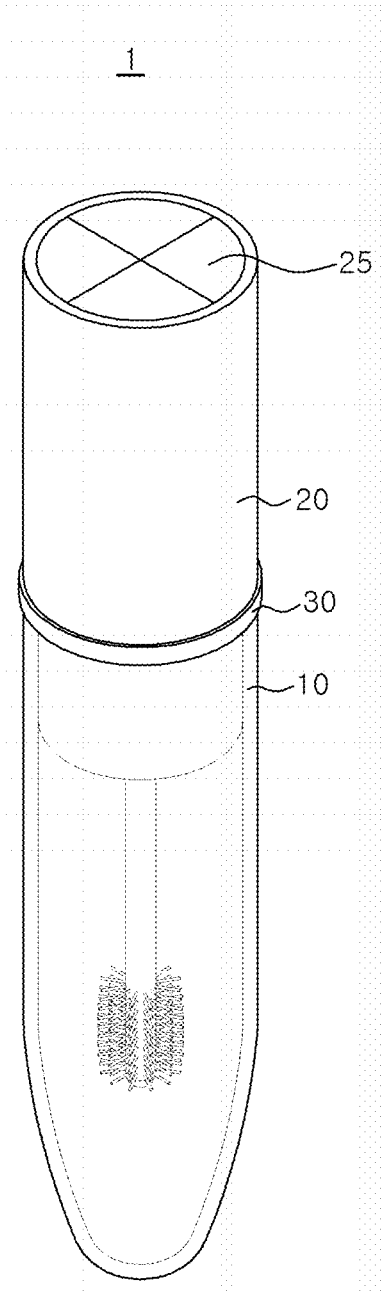

【FIG. 2】
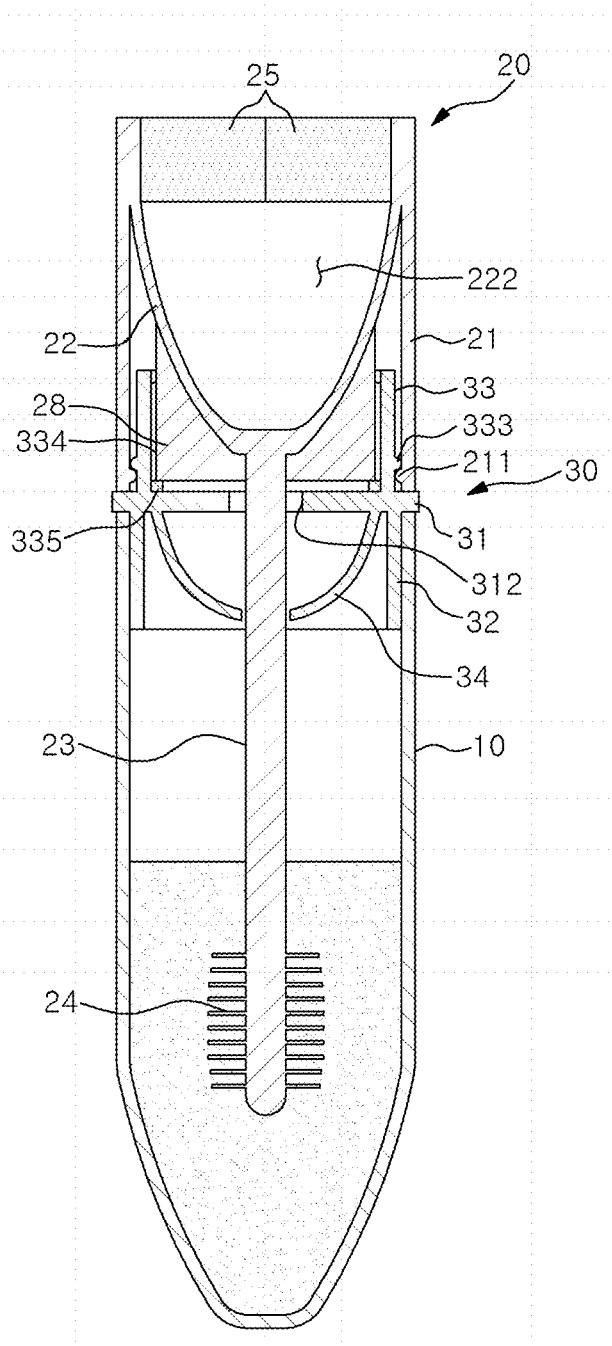

【FIG. 3】
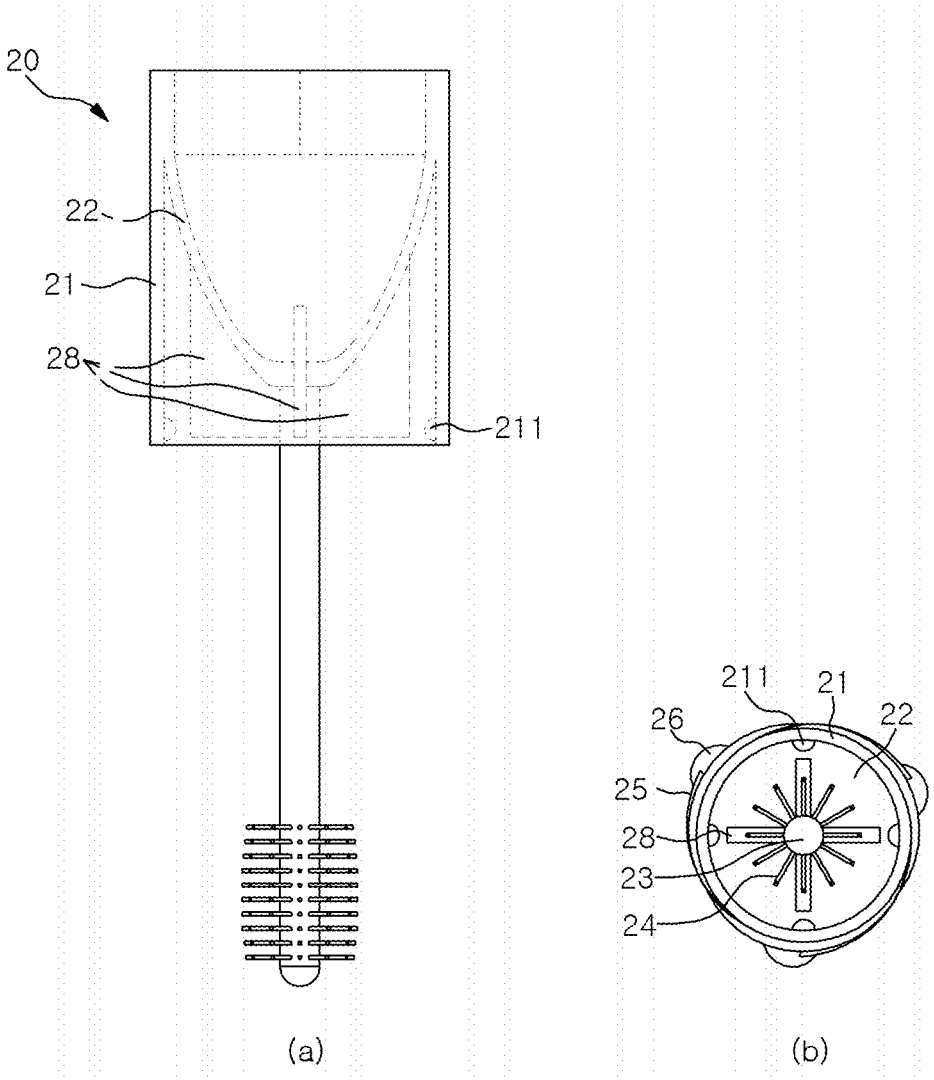

【FIG. 4】
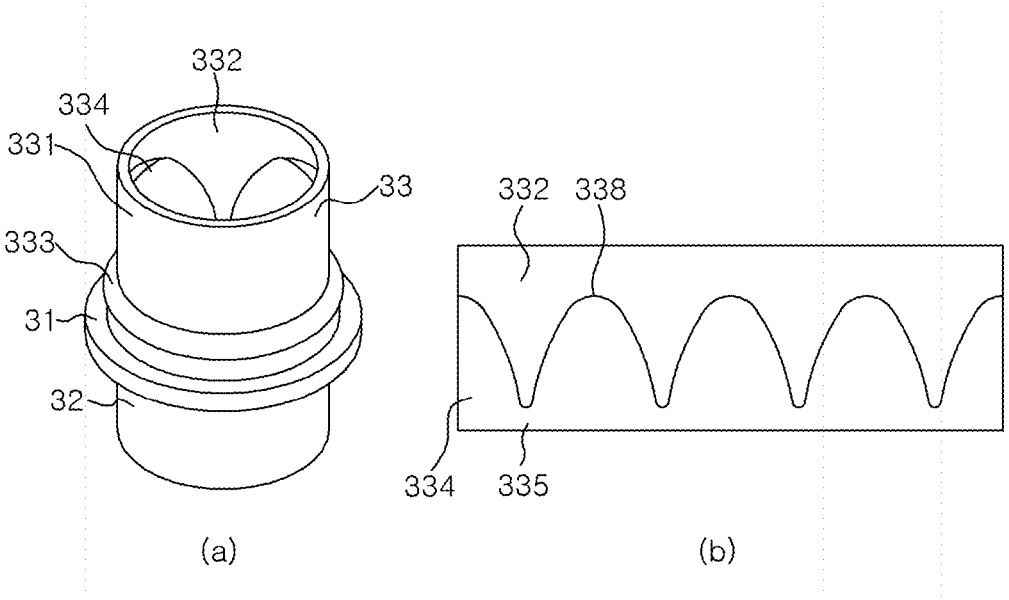
【FIG. 5】
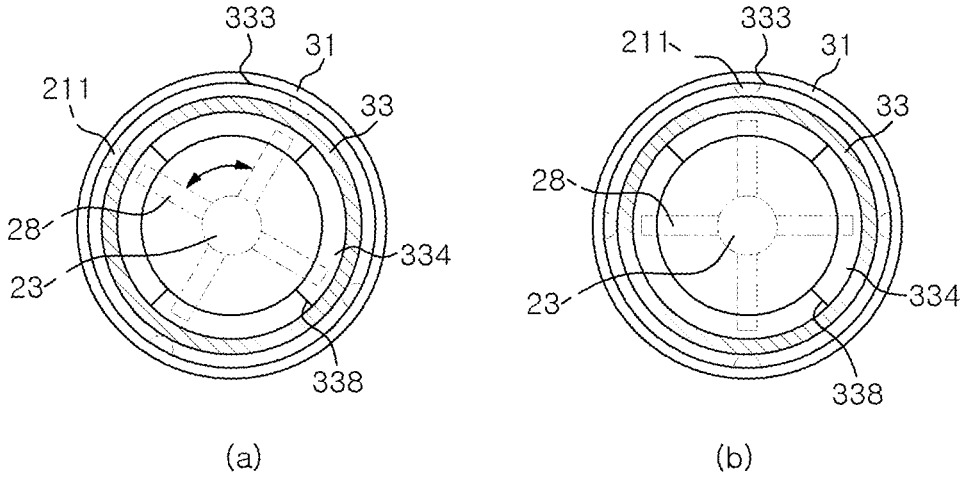

【FIG. 6】
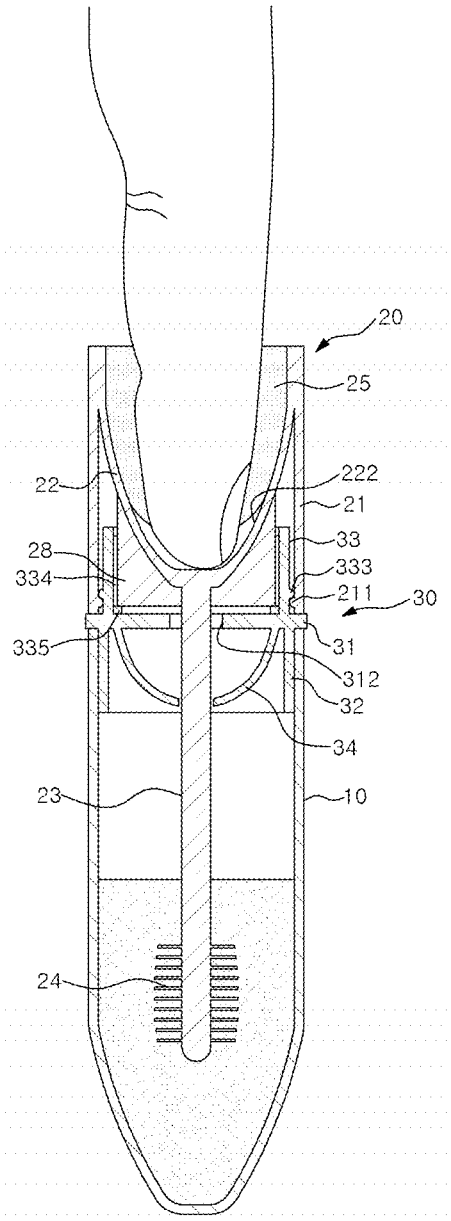

【FIG. 7】
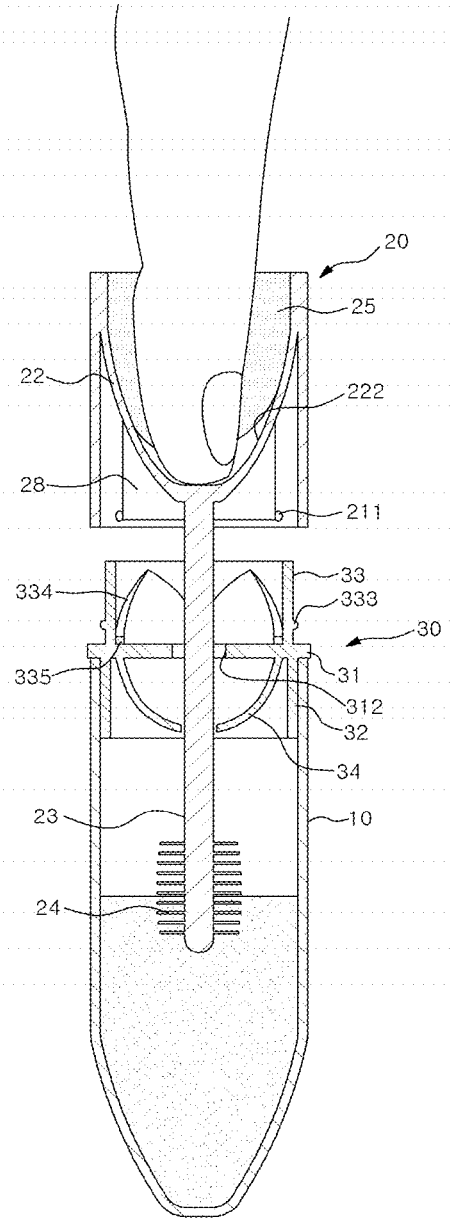

【FIG. 8】
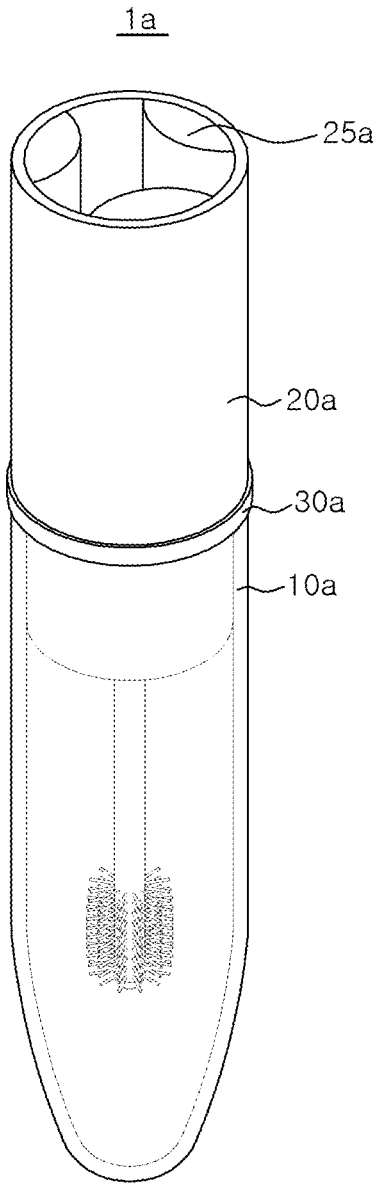

FINGER FITTING-TYPE MAKEUP TOOL

TECHNICAL FIELD

The present invention relates to a finger fitting-type makeup tool.

BACKGROUND ART

Makeup cosmetics are cosmetics which are applied on a body such as a face or nails to lent a splash of color and make skin color beautiful after a basic product is used, and which conceal skin defects which cannot be covered by the basic product. For example, the makeup cosmetics may be classified as a base makeup which can unify the color of the skin of an entire face or cover skin defects such as melasma and freckle, thereby fixing a skin healthily and beautifully, and a point makeup which locally highlights or shades lips, eyes, cheeks, nails or the like to deliver a three-dimensional effect, thus expressing his or her individuality. The base makeup includes, for example, a makeup base, a foundation, a powder and the like, and the point makeup includes, for example, a lip stick, an eyeliner, a mascara and the like.

The mascara, which is one of the point makeups, is a cosmetic for highlighting eyelashes, and is used in a method in which a cosmetic material is coated on a brush and applied on eyelashes.

Such mascara is generally constituted by a container in which a cosmetic material is contained, and a lid to which a stick and a brush are integrally coupled. When consumers open the lid, the brush coated with cosmetic material is extracted, and a user can do makeup by applying the cosmetic material coated on the brush on the eyelashes while holding the lid.

However, as a user must do eyelash makeup while holding the lid with the hand, it is difficult to do precise eyebrow makeup with a general mascara. Further, if a user inadvertently misses the lid held with the hand when doing eyelash makeup, a problem that the brush becomes dirty may occur.

In order to address the aforementioned problems, the applicant has proposed Korean Patent Application Publication Nos. 10-2017-0005966, 10-2017-0005967 and 10-2017-0005968. The technologies disclosed in the above patent documents relate to a mascara which enables a user to do makeup while fitting his/her finger into a finger inserting member to which a brush rod with a brush installed therein is connected.

However, in a case of the above mascara, a user should open the lid and fit his/her finger into the finger inserting member in order to use it for makeup, and thus there is a problem that the user should hold the lid with the other hand or store it separately so as not to lose it. If the lid is lost, the finger inserting member cannot be firmly fixed to the container and foreign matters may be entered into the inside of the container, so that the brush rod and the brush can be contaminated.

Further, the conventional finger inserting member is exposed directly to outside, and there has been a problem that the outer surface of the finger inserting member becomes dirt by cosmetic material while the brush rod and the brush enter and exit the container in which the cosmetic material is stored. In this case, a problem that a cosmetic material is smeared on a facial part which a user does not want during makeup may occur.

Further, in the conventional finger inserting member, the finger fixing part is formed so as to extend to an upper side of the finger inserting space, so there is a problem that the entire length becomes longer and thus it is inconvenient to store it.

Further, the finger inserting space is exposed to the outside when using the mascara, and thus foreign matters, such as dust or the like enter inside the finger inserting space, and are problematically attached to a user's fingertip or a nail after the use of the mascara, causing unpleasantness.

DISCLOSURE

Technical Problem

The exemplary embodiments of the invention, which have been conceived to address above-described problems, are to provide a finger fitting-type makeup tool which enables a user to do conveniently makeup using his/her finger.

Further, it is intended to provide a finger fitting-type makeup tool which can be used without a lid.

Further, it is intended to provide a finger fitting-type makeup tool whose application unit into which a user fits his/her finger can be firmly fixed to a container and can be used steadily.

Further, it is intended to provide a finger fitting-type makeup tool which can couple and separate an application unit and a container.

Further, it is intended to provide a finger fitting-type makeup tool which can prevent a problem that an outer surface of the application is contaminated by a cosmetic material and thus the cosmetic material is smeared on a region a user does not want.

Further, it is intended to provide a finger fitting-type makeup tool which it is convenient to store.

Further, it is intended to provide a finger fitting-type makeup tool which can prevent that a foreign matter is attached to a fingertip or a nail when it is used.

Technical Solution

According to an aspect of the present invention, there is provided a finger fitting-type makeup tool, comprising: a container in which an eyelash cosmetic material is received and which is open at an upper end thereof; an application unit coupled to the upper side of the container and allowing a user to fit his/her finger thereinto to apply the cosmetic material; and a middle unit for detachably coupling the application unit to the container, wherein the application unit includes: a finger fitting part which provides a fitting space into which the user can fit the finger from an upper side thereof; an outer tube which surrounds the circumference of the finger fitting part and is open at an upper side thereof; an elastic support part which is fixed to an inner surface of the finger fitting part, is elastically deformed when a finger is fitted into the fitting space, and is then restored to its original shape when the finger is removed therefrom; a stick extending downward from one point of the inner space of the outer tube; and a brush provided on an end portion of the stick to be usable for dipping and applying of the cosmetic material.

Further, there is provided a finger fitting-type makeup tool, wherein the elastic support part is formed of any one material among polyurethane foam, memory foam, latex, sponge, natural rubber, elastomer, urethane rubber, nitrile-butadiene rubber (NBR), silicone.

Further, there is provided a finger fitting-type makeup tool, wherein the elastic support part is formed so as to close a mouth portion of the finger fitting part.

Further, there is provided a finger fitting-type makeup tool, wherein the elastic support part is provided in plural along a circumference of the finger fitting part.

Further, there is provided a finger fitting-type makeup tool, wherein each of the elastic support parts is formed so as to surface contact with the adjacent elastic support part to close the mouth portion of the finger fitting part.

Further, there is provided a finger fitting-type makeup tool, wherein the elastic support part has a basic state where it is deformed in a state where no finger is fitted thereinto.

Further, there is provided a finger fitting-type makeup tool, wherein the middle unit includes, a base provided between the container and the outer tube, and provided with a penetration hole through which the stick and the brush pass; and an upper rib which is extended to an upper side of the base to be inserted into a space between the finger fitting part and the outer tube, and wherein a first catching protrusion is formed on any one of an inner surface of the outer tube and an outer surface of the upper rib, a second catching protrusion is formed on another one of the inner surface of the outer tube and the outer surface of the upper rib, and the application unit is fixed to the middle unit by means of elastic coupling of the first catching protrusion and the second catching protrusion, and is separated from the middle unit by means of release of the elastic coupling.

Further, there is provided a finger fitting-type makeup tool, wherein a plurality of sliding ribs is provided around the stick, and a guide is formed on an inner surface of the upper rib, the guide having a plurality of convex parts providing a guide surface which guides movement of the sliding rib, and which the sliding rib slides on, at a time of the coupling of the application unit.

Further, there is provided a finger fitting-type makeup tool, wherein when the application unit is fixed to the middle unit, the sliding rib slides along the guide and the outer tube is rotated, so that the first catching protrusion slides obliquely over the second catching protrusion to be elastically coupled to the second catching protrusion.

Further, there is provided a finger fitting-type makeup tool, wherein when the application unit is separated from the middle unit, the sliding rib slides along the guide and the outer tube is rotated, so that the first catching protrusion slides obliquely over the second catching protrusion to release the elastic coupling with the second catching protrusion.

Further, there is provided a finger fitting-type makeup tool, wherein the outer tube is formed so as to have a height equal to or lower than an end portion of the sliding rib.

Further, there is provided a finger fitting-type makeup tool, wherein the sliding rib has a plate shape extended lengthily downward, and is fixed to the finger fitting part and the stick, wherein between the sliding rib and the outer tube, there is provided a space into which the upper rib can be inserted, and wherein in a state where the application unit is coupled to the middle unit, the sliding rib is spaced apart from the inner surface of the upper rib.

Further, there is provided a finger fitting-type makeup tool, wherein the application unit is provided so as to be rotated by rotation of a finger fitted into the finger fitting part and the elastic support part.

Further, there is provided a finger fitting-type makeup tool, wherein the first catching protrusion is provided on the inner surface of the outer tube, and the second catching protrusion is provided on the outer surface of the upper rib.

Further, there is provided a finger fitting-type makeup tool, wherein the first catching protrusion is a plurality of protrusions, and the second catching protrusion is formed along the inner surface of the outer tube or the outer surface of the upper rib as a ring shape.

Advantageous Effects

According to the finger fitting-type makeup tool in accordance with exemplary embodiments of the invention, there is an advantage that a user can do makeup conveniently using his/her finger.

Further, there is an advantage that use convenience is improved since the application unit closes the container without a lid.

Further, there is an advantage that use convenience is improved since the application and the container are simply and conveniently coupled to and separated from each other.

Further, there is an advantage that it is possible to use stably since the application unit is firmly fixed to the container to serve as a lid.

Further, there is an advantage that user's satisfaction is improved since it is prevented that a body part the user does not want is smeared with cosmetic material which has contaminated the outer surface of the application unit.

Further, there is an advantage that storage is convenient since the total length can be reduced.

Further, there is an advantage that it is prevented that a foreign matter is attached to a fingertip or a nail of a user after use by preventing a foreign matter from entering the finger inserting space.

DESCRIPTION OF DRAWINGS

FIG. 1 is a perspective view showing an outer appearance of a finger fitting-type makeup tool according to an exemplary embodiment of the present invention.

FIG. 2 is a partial cross-sectional view of the finger fitting-type makeup tool of FIG. 1.

FIG. 3 is a front view and a bottom view of an application unit of FIG. 1.

FIG. 4 is a perspective view of a middle unit and an unfolded view of an inner surface of an application unit coupling part of FIG. 1.

FIG. 5 is a cross-sectional view illustrating a coupling process of the application unit and the middle unit of FIG. 1.

FIG. 6 is a cross-sectional view showing a state in which a finger is fitted into the application unit of FIG. 2.

FIG. 7 is a diagram showing a state in which the application unit of FIG. 2 is separated from the middle unit.

FIG. 8 is a perspective view showing an outer appearance of a finger fitting-type makeup tool according to another exemplary embodiment of the present invention.

BEST MODE

Hereinafter, specific exemplary embodiments of the present invention will be explained in detail with reference to the drawings.

Additionally, with regard to explaining the present invention, it is noted that the detailed description for known components or functions may be omitted herein so as not to obscure essential points of the disclosure.

Further, in the following description, an upper side direction means an upward direction on the basis of FIG. 1, and a lower side direction means a downward direction on the basis of FIG. 1. These upper side and lower side directions may be described as one side or another side of components.

FIG. 1 is a perspective view showing an outer appearance of a finger fitting-type makeup tool according to an exemplary embodiment of the present invention, FIG. 2 is a partial cross-sectional view of the finger fitting-type makeup tool of FIG. 1, FIG. 3 is a front view and a bottom view of an application unit of FIG. 1, FIG. 4 is a perspective view of a middle unit and an unfolded view of an inner surface of an application unit coupling part of FIG. 1.

Referring to FIGS. 1 to 4, a finger fitting-type makeup tool 1 according to an exemplary embodiment of the present invention may include a container 10 in which a cosmetic material for eyelash makeup is received; an application unit 20 coupled to the upper side of the container 10 and allowing a user to fit his/her finger thereinto to be used as a tool for applying the cosmetic material; and a middle unit 30 detachably coupling the application unit 20 to the container 10.

In the exemplary embodiment, the finger fitting-type makeup tool 1 is understood as a cosmetic product, which enables a user to fit his/her finger into the application unit 20 and move it to apply the cosmetic material. For example, the finger fitting-type makeup tool 1 may be a mascara, an eyeliner, an eyeshadow, or an eyebrow. Although, in the present exemplary embodiment, the finger fitting-type makeup tool 1 is described as being a mascara which is used for the purpose of making eyelashes appear longer and fuller, the technical idea of the present invention is not limited to it.

The container 10 can be formed in various shapes as long as it contains the cosmetic material, and in the exemplary embodiment, it is exemplified by a cylindrical one lengthily extended in an up and down direction and with an upper end opened.

The application unit 20, which is configured to apply the cosmetic material after a user fits his/her finger thereinto, may include an outer tube 21 with an upper side opened, a finger fitting part 22 provided inside the outer tube 21 to provide a fitting space 222 into which a user can fit his/her fingertip, a stick 23 extending downward from a lower end of the finger fitting part 22, a brush 24 formed at an end portion of the stick 23 to be coated with the cosmetic material, an elastic support part 25 disposed inside the finger fitting part 22 to surround a finger, and a first catching protrusion 211 which is formed on the inner surface of the outer tube 21 and is caught by a second catching protrusion 333 formed on an outer surface 331 of an upper rib 33 of the middle unit 30 when the application unit 20 is coupled with the middle unit 30.

The outer tube 21 may be formed with a size corresponding to an outer diameter of the container 10, and has a cylindrical shape surrounding a portion of the stick 23 and the finger fitting part 22 so as to prevent the portion of the stick 23 and the finger fitting part 22 from being exposed in a direction perpendicular to the extending direction of the stick 23. In this case, a predetermined space may be formed between the finger fitting part 22 and the stick 23, and the inner surface of the outer tube 21. In this space, a plurality of sliding ribs 28 may be provided for coupling the application unit 20 to the middle unit 30, and the upper rib 33 of the middle unit 30 to be described later may be inserted into this space.

With these features of the outer tube 21, the finger fitting part 22, the stick 23 and the middle unit 30 can be always located only at an inner side of the outer tube 21, and thus even when the finger fitting part 22, the stick 23 and the middle unit 30 are smeared with a cosmetic material, an outer circumferential surface of the outer tube 21 can be always kept at a clean state. Therefore, a problem that a user's face is smeared with the cosmetic material which has been smeared on a part except the brush 24 can be prevented.

In the exemplary embodiment, the outer tube 21, like the container 10, is described by way of example as being formed with a cylindrical shape having a predetermined height.

In the inner side of the outer tube 21, there is provided the finger fitting part 22 which is capable of accommodating a fingertip when a user fits his/her finger into the application unit 20. The finger fitting part 22 may be spaced from the inner surface of the outer tube 21 by a predetermined distance to form the space therebetween, in which the sliding ribs 28 are formed and into which the upper rib 33 is inserted, and may have a shape converging downward so as to correspond to a shape of a finger.

The coupling state between the finger fitting part 22 and the outer tube 21 may be maintained, so that, when a user moves his/her finger with the finger fitted into the finger fitting part 22, the entire outer tube 21 can be moved. As an example, the finger fitting part 22 may be integrally formed with the outer tube 21, and in such a case, the upper portion of the finger fitting part 22 and the upper portion of the outer tube 21 may be connected with each other.

The stick 23 is lengthily extended downward from a point in the inner space of the outer tube 21, and is appropriately formed to have such a length that the brush 24 provided at the end portion of the stick can be easily coated with the cosmetic material contained in the container 10.

In the exemplary embodiment, the stick 23 is illustrated by way of example as being extended lengthily from a lower end center portion of the finger fitting part 22, and as being formed integrally with the finger fitting part 22, but the technical idea of the invention is not limited thereto. For example, the stick 23 may be connected to the outer tube 21, or may have a configuration in which it is inserted into a predetermined insertion hole formed in the finger fitting part 22. Advantageously, in such a case, if the brush 24 is too dirty or damaged to be used for makeup, the stick 23 and the brush 24 can be replaced.

The elastic support part 25 may be provided so as to protrude from the inner surface of the finger fitting part 22 to the center side of the finger fitting space 222, and may elastically support a user's finger when the finger is fitted into the finger fitting part 22. More specifically, the elastic support part 25 may be formed of an elastically deformable material, and may be deformed upon the insertion of a user's finger and be restored to its original shape upon the extraction of the user's finger. For example, the elastic support part 25 may be formed of a material, such as, polyurethane foam, memory foam, latex, sponge, natural rubber, elastomer, urethane rubber, nitrile-butadiene rubber (NBR), silicone or the like, that can be elastically deformed when an external force is applied thereto, and can be restored to its original shape when the external force is disappeared.

Such elastic support part 25 may be fixed to the inner surface of the finger fitting part 22 at its one side, while the other side thereof may be a free end and can be deformed when a finger is inserted. Under a state of no external force, the elastic support part 25 may be restored to and maintain its original shape after having been deformed. The elastic support part 25 may be fixed to the inner surface of the finger fitting part 22 by way of bonding or fitting-coupling, and the fixing method thereof does not limit the technical idea of the present invention.

Here, the elastic support part 25 may be provided so as to close the mouth portion of the finger fitting part 22 when no finger is inserted. For example, in a case where the elastic support part 25 is constituted by a plurality of components, they may be provided so as to contact each other, while, in a case where it is constituted by a single component, the component may contact the inner surface of the finger fitting part 22 along the circumference of the finger fitting part 22.

Further, the elastic support part 25 may be provided so as to be deformed to a certain degree even when a user's finger is not inserted thereinto. For example, the elastic support part 25 may be formed such that undeformed size thereof is greater than the size of the finger fitting part 22, and thus, in a basic state where it is installed at the finger fitting part 22, the elastic support part 25 may be deformed to a certain degree. Therefore, the elastic support part 25 can more effectively close the mouth portion of the finger fitting part 22 when no finger is inserted.

In the exemplary embodiment, the elastic support part 25 will be described by way of example as being a plurality of polyurethane foams each of which has a planar surface of a circular sector shape protruding from the inner surface of the finger fitting part 22. The elastic support part 25 may be bonded and fixed to the inner surface of the finger fitting part 22 along the circumference of the finger fitting part 22, and for example, it may be a circular sector shape with a center angle of 90 degree as shown.

In this case, the side surface and the central vertex of each of the elastic support parts 25 may contact the side surface and the central vertex of the adjacent elastic support part 25 in a state where no finger is fitted into the finger fitting part 22. Therefore, the mouth portion of the finger fitting part 22 can be closed, and it can be prevented that a foreign matter enters into the finger fitting space 222 and a user's fingertip or nail is smeared with the foreign matter when the user fits his/her finger thereinto.

Here, each of the elastic support parts 25 may be formed with such a size that it can be overlap the adjacent elastic support part 25 in a basic state where no finger is fitted thereinto. Therefore, each of the elastic support parts 25 can be deformed to a certain degree by the adjacent elastic support part 25 to have a restoring force at the basic state, and thereby a contacting force between the elastic support parts 25 can be improved and more effectively prevent a foreign matter penetration.

This elastic support part 25 may be disposed at the mouth portion of the finger fitting part 22 so as to have a predetermined thickness, and is elastically deformed when a user's finger is fitted into the finger fitting part 22. When the finger is entered into the finger fitting part 22, the elastic support part 25 can be deformed away from a central axial direction of the outer tube 21, so that the finger can be supported by the elastic force thereof proportional to the deformation amount. According to this, a user can fit his/her finger easily into the finger fitting part 22 regardless of the thickness of the finger, while at the same time the finger can be supported stably by the elastic support part 25, so that eyelash makeup can be precisely performed without shaking of the application unit 20.

In this case, the size of the space provided by the elastic support part 25 may be set based on a person having a thin finger, or may be set to be smaller than it.

The number, the size, the location, the shape, the fixing method or the like of the elastic support part 25 may be varied according to an exemplary embodiment.

Meanwhile, the present exemplary embodiment is exemplified that side surfaces of the plurality of elastic support parts 25 contact each other, but they may be disposed to be spaced apart from each other. Therefore, a user can intuitively recognize a position into which a finger is to be inserted as a gap between the elastic support parts 25, and the length of time taken until the elastic support part 25 is restored to its original shape can be set shorter, thus improving use convenience.

Further, in a case where the elastic support parts 25 is provided in plural, some of the elastic support parts 25 may be disposed at a height different from that of other elastic support part 25. In this case, the elastic support part 25 can support a finger at several points in a length direction of finger, so that the state where the finger is fitted into the finger fitting part 22 can be more firmly maintained.

Meanwhile, the outer tube 21 may have an inner diameter greater than an outer diameter of the upper rib 33 of the middle unit 30, and the first catching protrusion 211 may be protrusively formed from the inner surface of the outer tube 21. As the first catching protrusion 211 and the outer tube 21 are provided so as to be elastically deformed when the application unit 20 and the middle unit 30 are coupled, a portion where the first catching protrusion 211 is formed is elastically deformed and is caught by the second catching protrusion 333. In a state where the application unit 20 and the middle unit 30 are coupled, a distance between the inner circumferential surface of the outer tube 21 and the outer surface of the upper rib 33 may correspond to a height of the first catching protrusion 211 and the second catching protrusion 333.

The first catching protrusion 211 may be formed in plural on the inner surface of the outer tube 21, and in the present exemplary embodiment, four semicircle-shaped protrusions are illustrated by way of example as being disposed along the circumference of the outer tube 21 at an interval of 90 degrees. Further, the first catching protrusion 211 is illustrated by way of example as being disposed at a location close to a lower end of the outer tube 21. However, the number, position and shape of the first catching protrusions 211 are not limited to the present exemplary embodiment. For example, similarly to the second catching protrusion 333, the first catching protrusion 211 may be protruded from the inner surface of the outer tube 21 entirely to have a ring shape.

Further, in the inner space of the outer tube 21, the plurality of sliding ribs 28 may be formed for guiding the coupling and separation of the application unit 20. In the exemplary embodiment, although four sliding ribs 28 disposed around the stick 23 at 90-degree interval are illustrated by way of example, the number and the interval of the sliding ribs 28 do not limit the technical spirit of the invention.

The sliding ribs 28 may be secured to an outer peripheral surface of the finger fitting part 22 and an outer peripheral surface of the stick 23, or according to an exemplary embodiment, may be secured to only one of the finger fitting part 22 and the stick 23, or may be formed integrally with the both. In this case, the sliding rib 28 may have a plate shape extending lengthily in an up and down direction, and a lower end of the sliding rib 28 may slide along a guide 334 of the middle unit 30 to be described later. As such, the outer tube 21 can be rotated to be coupled to the middle unit 30 or separated from the middle unit 30. For a smooth sliding movement of this sliding rib 28, a lower end portion of the sliding rib 28 may be subjected to being rounded, and be provided. In the exemplary embodiment, the sliding rib 28 is described by way of example as being a plate extending lengthily in the up and down direction, but the technical spirit of the invention is not limited thereto. For example, the sliding rib 28 may have a bar shape which is protruded from the circumference of the stick 23.

As in the present exemplary embodiment, in a case where the sliding rib 28 is provided in a plate shape secured to the finger fitting part 22 and the stick 23, there are advantages that the load produced when the application unit 20 is fitted or separated can be easily supported, and that the finger fitting part 22 can be more firmly supported also by the sliding rib 28.

Meanwhile, a side edge of the sliding rib 28 is formed so as to be spaced apart from the inner surface of the outer tube 21. Into a space between the side edge of the sliding rib 28 and the inner surface of the outer tube 21, the upper rib 33 can be inserted.

In addition, in the exemplary embodiment, the side edge of the sliding rib 28 is illustrated as being spaced apart from the inner surface 332 of the upper rib 33 by a predetermined distance for allowing the sliding rib 28 to be easily entered into the inside of the upper rib 33, but according to an exemplary embodiment, the side edge of the sliding rib 28 may contact the inner surface 332 of the upper rib 33.

In this case, a lower end of the outer tube 21 may be formed so as to have a height position equal to or lower than a lower end of the coupling rib 28, preventing the sliding rib 28 from being exposed to a side. With this, even when the sliding rib 28 becomes dirty by the cosmetic material, the problem that the cosmetic material is smeared on other body part can be effectively prevented.

The middle unit 30 serves as a medium for coupling the container 10 with the application unit 20, and may be formed integrally with the container 10 according to an embodiment.

Specifically, the middle unit 30 may include a base 31 positioned between the container 10 and the outer tube 21, a lower rib 32 protruded toward a lower side of the base 31 to be inserted into the container 10, and the upper rib 33 protruded toward an upper side of the base 31 to be inserted into the inside of the outer tube 21.

The base 31 may have a circular plate shape with a penetration hole 312 at the center for allowing the penetration of the stick 23, and may be fixed by the edge being seated on the upper end of the container 10.

The lower rib 32 may be formed with a size corresponding to the inner diameter of the container 10, so that the middle unit 30 can be firmly fitted into and coupled with the container 10. In the exemplary embodiment, the coupling of the middle unit 30 and the container 10 is described by way of example as the fitting-coupling by the lower rib 32, but various known coupling method, such as screw coupling and the like, can be used for the coupling of the middle unit 30 and the container 10.

In the inside of the lower rib 32, there may be provided a wiper 34 which is capable of scraping the cosmetic material adhered on the stick 23 when the application unit 20 is separated. At a center of the wiper 34, there may be formed a hole through which the stick 23 and the brush 24 can pass. Although the present exemplary embodiment exemplifies that the wiper 34 is integrally formed with the lower rib 32 and the base 31, the technical spirit of the invention is not limited thereto. For example, the wiper 34 may be formed of an elastic material, such as natural rubber, elastomer, urethane rubber, NBR, silicone or the like so as to be elastically deformed by the stick 23 and the brush 24, and may be assembled to the base 31 or the lower rib 32. Winkles may be formed in the wiper 34 for smooth elastic deformation.

The wiper 34 may be formed in a configuration where its diameter becomes smaller as it goes down. In this case, the cosmetic material scraped by the wiper 34 may be moved upward and caught in a space between the wiper 34 and the lower rib 32, and on the outer surface of the wiper 34, there is provided a back flow prevention rib (not shown) which may be protrusively formed so as to be inclined downward in order to drop downward the cosmetic material moving upward along the outer surface of the wiper 34. Alternatively, the space between the wiper 34 and the lower rib 32 may be omitted or minimized in order to reduce a sub-material and improve sealing ability.

The upper rib 33 has a cylindrical shape extended upward from the base 31, and when the application unit 20 is coupled to the middle unit 30, the end portion of the finger fitting part 22, the sliding rib 28, and the stick 23 may be disposed within the upper rib 33.

On the outer circumferential surface 331 of the upper rib 33, there is provided the second caught protrusion 333 to which the first catching protrusion 211 can be elastically deformed and be hook-coupled. The second catching protrusion 333 may be formed with a ring shape along the circumference of the outer circumferential surface 331, and formed at a point spaced apart by a predetermined height from the base 31. Into a space between the base 31 and the second catching protrusion 333, the first catching protrusion 211 is fitted upon the coupling of the application unit 20. As the second catching protrusion 333 is formed along the entire circumference of the outer circumferential surface 331 of the upper rib 33, the first catching protrusion 211 can be caught regardless of a fitting angle of the application unit 20.

The present exemplary embodiment exemplifies that the first catching protrusion 211 is formed in the outer tube 21 of the application unit 20 and the second catching protrusion 333 is formed in the upper rib 33 of the middle unit 30, but the positions of the first catching protrusion 211 and the second catching protrusion 333 may be exchanged each other. That is, the second catching protrusion 333 may be formed entirely on the inner surface of the outer tube 21, and a plurality of the first catching protrusions 211 may be formed on the upper rib 33. Further, upon the coupling and the separation of the application unit 20, at least one of the application unit 20 and the middle unit 30 may be provided so as to be elastically deformed, so that the first catching protrusion 211 can slide obliquely over the second catching protrusion 333.

Here, the first catching protrusion 211 and the second catching protrusion 333, which are formed on the inner surface of the outer tube 21 and the outer surface 331 of the upper rib 33 to couple and fix the application unit 20 and the middle unit 30 to each other, may be referred to as a "fixing unit".

On the inner surface 332 of the upper rib 33, there is provided the guide 334 which guides the movement of the sliding rib 28 upon the coupling and the separation of the application unit 20 and the middle unit 30. The guide 334 may include a plurality of convex parts 338 protrusively formed in a predetermined length from the inner circumferential surface 332 of the upper rib 33 to be convex upward. Here, the number of the convex parts 338 are provided correspondingly to the number and the positions of the sliding rib 28, and the present exemplary embodiment exemplifies that four convex parts 338 are provided along the inner circumferential surface of the upper rib 33 at an interval of 90 degrees.

Specifically, the guide may include a slope extending from a peak, which is farthest from the lower end of the upper rib 33, to a trough, which is closest from the lower end of the upper rib 33, and the peak and the trough may be disposed alternatively along the inner circumferential surface 332, so that the guide 334 has a plurality of the convex parts 338 convex upward as shown.

The protruded slope of the convex part 338 serves as a guide surface which the sliding rib 28 contacts and slides on. That is, the convex part 338 provides a guide surface of the sliding rib 28. In this case, the peak of the convex part 338, the slope and the guide surface between the convex parts 338 may be formed with curved surface so as to guide the sliding rib 28 smoothly, and in the present exemplary embodiment, the slope is illustrated as having a convex-upward curvature.

Meanwhile, between the convex parts 338, there may be provided a support part 335 which can support the sliding rib 28 upon the completion of the coupling of the application unit 20.

With the guide 334 configured like this, even when a user couples the application unit 20 to the middle unit 30 in an arbitrary direction, the sliding rib 28 is first brought into contact with the guide 334, and slides along the slope of the guide 334 to be guided to a space between the convex parts 338. Accordingly, the outer tube 21 is rotated and fitted onto the upper rib 33, and the first catching protrusion 211 slides obliquely over the second catching protrusion 333 to be caught by the second catching protrusion 333, so that the application unit 20 is coupled to the middle unit 30. At the time of this catching action or a catching release action to be described later, the first catching protrusion 211 is not moved in a direction perpendicular (an up and down direction of FIG. 2) to the protruding direction of the second catching protrusion 333 (a left and right direction of FIG. 2), but is moved in an oblique direction while at the same time being guided by the guide 334, so that a user can perform the coupling and the separation manipulation of the application unit 20 with more smoothness and convenience.

In a state where the coupling of the application unit 20 is completed, the lower end of the outer tube 21 is seated on the base 31, the sliding rib 28 is seated on the support part 335, and the first catching protrusion 211 maintains the catching state so as to closely contact the second catching protrusion 333.

Meanwhile, a user can separate the application unit 20 from the middle unit 30 just by rotating his/her finger with the finger fitted into the application unit 20. When a user fits his/her finger into the finger fitting part 22 of the application unit 20, the elastic support part 25 firmly holds the finger, and if the user rotates the finger under this state, the elastic support part 25 and the finger fitting part 22 are rotated together, and thus, the entire application unit 20 is rotated. At this time, the sliding rib 28 slides on and is moved along the slope of the guide 334, that is, it is rotated and moved in a direction away from the base 31. Put it another way, the outer tube 21 is moved away from the base 31, and thus the first catching protrusion 211 slides obliquely over the second catching protrusion 333 to be released from the state where it is caught by the second catching protrusion 333. Therefore, the application unit 20 can be freely extracted from the middle unit 30.

Hereinafter, a method for assembling and a method for using the finger fitting-type makeup tool 1 according to an exemplary embodiment of the invention having the aforementioned configuration will be described.

FIG. 5 is a cross-sectional view illustrating a coupling process of the application unit and the middle unit of FIG. 1, FIG. 6 is a cross sectional view showing a state in which a finger is fitted into the application unit of FIG. 2, FIG. 7 is a diagram showing a state in which the application unit of FIG. 2 is separated from the middle unit.

In FIG. 5, for convenience of explanation, the configuration of the application unit 20 is represented by two-dot chain line.

When describing the method for assembling the finger fitting-type makeup tool 1 first with reference to FIGS. 5 to 7, the middle unit 30 is provided while being in a coupling state to the container 10. The lower rib 32 of the middle unit 30 is press-fit into the container 10 so as not to drop out of it, and the coupling between the middle unit 30 and the container 10 can be firmly maintained even though the middle unit 30 and the application unit 20 are repeatedly coupled to and separated from each other.

And the application unit 20 is coupled to the middle unit 30. The application unit 20 is coupled from top to bottom, so that the brush 24 and the stick 23 can pass through the penetration hole 312 of the base 31. At this time, the outer tube 21 is coupled along the outer circumferential surface of the upper rib 33 of the middle unit 30. Additionally, as the application unit 20 is moved down, the sliding rib 28 is brought into contact with the guide 334, and guided along the slope of the guide 334. For example, when the sliding rib 28 is brought into contact with the slope of the guide 334 as shown in FIG. 5*a*, the contact point is on the left portion from the convex part 338, and thus the sliding rib 28 and the application unit 28 are rotated anticlockwise as they are going down. Under this state, the first catching protrusion 211 is positioned above the second catching protrusion 333 (in a direction farther from the base 31).

And, if a user further moves the application unit 20 downward by exerting an external force, the first catching protrusion 211 is brought into contact with the second catching protrusion 333, and according to the downward movement of the application unit 20 and the sliding movement of the sliding rib 28, the first catching protrusion 211 slides obliquely over the second catching protrusion 333, so that the application unit 20 is coupled to the middle unit 30. At this time, the end of the sliding rib 28 is supported by the support part 335, and the lower end of the outer tube 21 is also brought into contact with the base 31, so that the application unit 20 cannot be moved further. FIG. 5*b* shows a state where the application unit 20, which has been fitted as shown in FIG. 5*a*, is rotated and coupled to the middle unit 30, and in this state, the first catching protrusion 211 of the application unit 20 is located lower than the second catching protrusion 333 (in a direction closer to the base 31).

In such coupling state of the application unit 20, the brush 24 can be put into the cosmetic material contained in the container 10, so that the cosmetic material is adhered to the brush 24.

Then, the user, who wants to apply the cosmetic material, fits his/her finger into the elastic support parts 25 and the finger fitting part 22 as shown in FIG. 6, and can separate the application unit 20 from the middle unit 30 by rotating the finger in an arbitrary direction. The present exemplary embodiment illustrates by way of example that the user rotates the finger clockwise on the basis of FIG. 6 to extract the application unit 20.

Specifically, when the user fits the finger into the application unit 20 and rotates the outer tube 21, the sliding rib 28 is moved along the slope of the guide 334 by means of the rotational force exerting on the outer tube 21 through the elastic support part 25, and thereby the application unit 20 can be naturally rotated and moved upward. This rotation and upward movement of the outer tube 21 causes the first catching protrusion 211 to slide obliquely over the second catching protrusion 333, so that the coupling of the application unit 20 and the middle unit 30 can be released.

Hereinafter, operation and effects of the finger fitting-type makeup tool 1 according to the exemplary embodiment of the invention having such a configuration as described above will be discussed.

A user may couple and separate the application unit 20, with/from the container 10 and the middle unit 30 in the aforementioned method. At ordinary time, the user stores the application unit 20 by fitting it in the middle unit 30, whereas when makeup is needed, the user fits his/her finger into the elastic support part 25 and the finger fitting part 22, extracts the application unit 20, and does makeup using the finger.

At this time, as the elastic support part 25 is capable of being elastically deformed according to the thickness of a user's finger and supporting the finger, the one structure can be used for all users having various finger thicknesses. In particular, as demands of various customers can be satisfied by only one model, a manufacturer of mascara can improve productivity.

Further, the elastic support part 25 is formed inside the finger fitting part 22, and thus can prevent the product from unnecessarily becoming longer. Most customers of mascaras store their mascaras in their small pouches, and the present exemplary embodiment can shorten the total length, thereby improving storage convenience.

In particular, in a case where the elastic support part 25 is provided so as to close the mouth portion of the finger fitting part 22 in a state where no finger is fitted thereinto, it can be prevented that foreign matter enters into the finger fitting space 222 even when the finger fitting-type makeup tool 1 is stored in the pouch or the like. Therefore, the finger fitting space 222 can always be kept clear, and thus the use satisfaction can be improved.

Further, in the prior art, there was a problem that a cosmetic material was smeared on a mouth portion of a container and an application tool as the stick and the brush are repeatedly entered into and extracted from the inside of the container. In particular, if a cosmetic material is smeared on an outer circumferential surface of a grip part of a mascara to which the stick is fixed, there was a problem that the cosmetic material is frequently smeared on a face during makeup. In contrast, in the exemplary embodiment, by forming the outer tube 21 and disposing the finger fitting part 22, the first catching protrusion 28 and the like within the outer tube 21, the cosmetic material is not smeared on an outer surface of the application unit 20. Therefore, the problem that a cosmetic material is inadvertently smeared on the face while a user is doing makeup can be prevented.

Furthermore, there is an advantage that a lid of a mascara container can be omitted as the application unit 20 where the outer tube 21 and the finger fitting part 22 are formed serves itself as a lid of the container. In particular, when the application unit 20 is coupled to the middle unit 30, the upper rib 33 is inserted into the inside of the outer tube 21, so that outside foreign matter is effectively prevented from entering into the inside of the container 10. In this case, inconvenience that a user should keep a lid separately while using a mascara can be removed, thus improving the use convenience.

Further, the fixing state of the application unit 20 can be doubly maintained by the sliding rib 28 being fitted into the space between a plurality of the convex parts 338 provided on the guide 334, as well as the elastic coupling of the first catching protrusion 211 and the second catching protrusion 333.

Further, in the process of using the finger fitting-type makeup tool 10, according to the present exemplary embodiment, just by separation of the application unit made by the finger fitting and the finger rotation, makeup can be done, and the process of finishing the use is similar to this, so that a user can do mascara makeup with more convenience, whereas in the prior art, after lid separation, finger fitting, and application unit separation, makeup could be done. Furthermore, in a case of the present exemplary embodiment, makeup can be done just by single action, that is, fitting and rotating the finger.

Further, although a user fits the application unit 20 onto the middle unit 30 in an arbitrary direction at the time of coupling the application unit 20, the sliding rib 28 can be guided along the guide 334 to be inserted precisely, and at the time of separation, the coupling of the application unit 20 and the middle unit 30 can be released just by action of fitting the finger into the application unit 20 and rotating it, so that the user can couple and separate the application unit 20 and the middle unit 30 very simply and conveniently, thus improving the use convenience.

Particularly, at the time of the coupling and the separation of the application unit 20, the interaction between the sliding rib 28 and the guide 334 causes the first catching protrusion 211 to move obliquely with respect to the second catching protrusion 333, so that the coupling and the separation of the application unit 20 can be done with less force. Therefore, when the finger fitting-type makeup tool 10 is not used and in a storage state, the application unit 20 is elastically coupled to the middle unit 30 to firmly maintain the fixing state, while, when attempting to do makeup or finishing makeup, a user can simply and conveniently separate and couple the application unit 20.

Hereinafter, a finger fitting-type makeup tool according to another exemplary embodiment of the invention will be described with reference to FIG. 8. However, as the exemplary embodiment of FIG. 8 is different from the exemplary embodiment of FIG. 1 in a configuration of the elastic support part, such different features will be mainly described, while reference to the above-described embodiment will be made for the description and reference numerals of same parts.

FIG. 8 is a perspective view showing an outer appearance of a finger fitting-type makeup tool according to another exemplary embodiment of the present invention.

Referring to FIG. 8, an elastic support part 25*a* of a finger fitting-type makeup tool 1*a* according to still another exemplary embodiment may be a plurality of elastic bodies which are formed inside an outer tube of an application unit 20*a*, surround a space into which a finger can be inserted and are fixed on the inside of the outer tube of the application unit 20*a* at a constant interval. In the present exemplary embodiment, the elastic support part 25*a* is illustrated by way of example as being memory foams which are disposed at an interval of 120 degree and protruded to a predetermined thickness.

In this case, there is an effect that the finger can be firmly supported while minimizing deformation amount of the elastic support part 25*a*, and an effect that the effect can be exhibited sufficiently even when the diameters of the application unit 20*a*, the container 10*a* and the middle unit 30*a* are decreased.

Followings are a list of exemplary embodiments of the invention.

Item 1 is a finger fitting-type makeup tool, comprising: a container in which an eyelash cosmetic material is received and which is open at an upper end thereof; an application unit coupled to the upper side of the container and allowing a user to fit his/her finger thereinto to apply the cosmetic material; and a middle unit for detachably coupling the application unit to the container, wherein the application unit includes: a finger fitting part which provides a fitting space into which the user can fit the finger from an upper side thereof; an outer tube which surrounds the circumference of the finger fitting part and is open at an upper side thereof; an elastic support part which is fixed to an inner surface of the finger fitting part, is elastically deformed when a finger is fitted into the fitting space, and is then restored to its original shape when the finger is removed therefrom; a stick extending downward from one point of the inner space of the outer tube; and a brush provided on an end portion of the stick to be usable for dipping and applying of the cosmetic material.

Item 2 is a finger fitting-type makeup tool according to Item 1, wherein the elastic support part is formed of any one material among polyurethane foam, memory foam, latex, sponge, natural rubber, elastomer, urethane rubber, nitrile-butadiene rubber (NBR), silicone.

Item 3 is a finger fitting-type makeup tool according to Items 1 and 2, wherein the elastic support part is formed so as to close a mouth portion of the finger fitting part.

Item 4 is a finger fitting-type makeup tool according to Items 1 to 3, wherein the elastic support part is provided in plural along a circumference of the finger fitting part.

Item 5 is a finger fitting-type makeup tool according to Items 1 to 4, wherein each of the elastic support parts is formed so as to surface contact with the adjacent elastic support part to close the mouth portion of the finger fitting part.

Item 6 is a finger fitting-type makeup tool according to Items 1 to 5, wherein the elastic support part has a basic state where it is deformed in a state where no finger is fitted thereinto.

Item 7 is a finger fitting-type makeup tool according to Items 1 to 6, wherein the middle unit includes, a base provided between the container and the outer tube, and provided with a penetration hole through which the stick and the brush pass; and an upper rib which is extended to an upper side of the base to be inserted into a space between the finger fitting part and the outer tube, and wherein a first catching protrusion is formed on any one of an inner surface of the outer tube and an outer surface of the upper rib, a second catching protrusion is formed on another one of the inner surface of the outer tube and the outer surface of the upper rib, and the application unit is fixed to the middle unit by means of elastic coupling of the first catching protrusion and the second catching protrusion, and is separated from the middle unit by means of release of the elastic coupling.

Item 8 is a finger fitting-type makeup tool according to Items 1 to 7, wherein a plurality of sliding ribs is provided around the stick, and a guide is formed on an inner surface of the upper rib, the guide having a plurality of convex parts providing a guide surface which guides movement of the sliding rib, and which the sliding rib slides on, at a time of the coupling of the application unit.

Item 9 is a finger fitting-type makeup tool according to Items 1 to 8, wherein when the application unit is fixed to the middle unit, the sliding rib slides along the guide and the outer tube is rotated, so that the first catching protrusion slides obliquely over the second catching protrusion to be elastically coupled to the second catching protrusion.

Item 10 is a finger fitting-type makeup tool according to Items 1 to 9, wherein when the application unit is separated from the middle unit, the sliding rib slides along the guide and the outer tube is rotated, so that the first catching protrusion slides obliquely over the second catching protrusion to release the elastic coupling with the second catching protrusion.

Item 11 is a finger fitting-type makeup tool according to Items 1 to 10, wherein the outer tube is formed so as to have a height equal to or lower than an end portion of the sliding rib.

Item 12 is a finger fitting-type makeup tool according to Items 1 to 11, wherein the sliding rib has a plate shape extended lengthily downward, and is fixed to the finger fitting part and the stick, wherein between the sliding rib and the outer tube, there is provided a space into which the upper rib can be inserted, and wherein in a state where the application unit is coupled to the middle unit, the sliding rib is spaced apart from the inner surface of the upper rib.

Item 13 is a finger fitting-type makeup tool according to Items 1 to 12, wherein the application unit is provided so as to be rotated by rotation of a finger fitted into the finger fitting part and the elastic support part.

Item 14 is a finger fitting-type makeup tool according to Items 1 to 13, wherein the first catching protrusion is provided on the inner surface of the outer tube, and the second catching protrusion is provided on the outer surface of the upper rib.

Item 15 is a finger fitting-type makeup tool according to Items 1 to 14, wherein the first catching protrusion is a plurality of protrusions, and the second catching protrusion is formed along the inner surface of the outer tube or the outer surface of the upper rib as a ring shape.

Item 16 is a finger fitting-type makeup tool, comprising: a container in which an eyelash cosmetic material is received and which is open at an upper end thereof; an application unit coupled to the upper side of the container and allowing a user to fit his/her finger thereinto to apply the cosmetic material; and a middle unit for detachably coupling the application unit to the container, wherein the application unit includes: a finger fitting part which provides a fitting space into which the user can fit the finger from an upper side thereof; an outer tube which surrounds the circumference of the finger fitting part and is open at an upper side thereof; an elastic support part which is provided in the outer tube, and is elastically deformed to surround a finger fitted thereinto from above; a stick extending downward from one point of the inner space of the outer tube; and a brush which is provided on an end portion of the stick and is capable of being coated with and applying the cosmetic material, wherein the middle unit includes: a base provided between the container and the outer tube, and provided with a penetration hole through which the stick and the brush pass; and an upper rib which is extended to an upper side of the base to be inserted into a space between the finger fitting part and the outer tube, wherein a first catching protrusion is formed on any one of an inner surface of the outer tube and an outer surface of the upper rib, and a second catching protrusion is formed on another one of the inner surface of the outer tube and the outer surface of the upper rib, and wherein the application unit is fixed to the middle unit by means of elastic coupling of the first catching protrusion and the second catching protrusion, and is separated from the middle unit by means of release of the elastic coupling.

While the finger fitting-type makeup tools according to exemplary embodiments of the disclosure are described as concrete embodiments, these are just examples, and the present invention should be construed in a broadest scope based on the fundamental ideas disclosed herein, rather than being limited to them. By combining or replacing a part or parts of embodiments disclosed herein, the ordinary skilled in the art may carry out a type of form which is not explicitly described herein, and however, it should be noted that it does not depart from the scope of the present invention. Besides, the ordinary skilled in the art may easily change or modify embodiments disclosed herein based on the disclosure, and however, it is obvious that such change or modification also falls within the scope of the present invention.

INDUSTRIAL APPLICABILITY

The present invention can be used in the field of the cosmetics industry.

The invention claimed is:

1. A finger fitting-type makeup tool, comprising:

a container in which an eyelash cosmetic material is received and which is open at an upper end thereof;

an application unit coupled to the upper side of the container and allowing a user to fit his/her finger thereinto to apply the cosmetic material; and a middle unit for detachably coupling the application unit to the container, wherein the application unit includes:

a finger fitting part which provides a fitting space into which the user can fit the finger from an upper side thereof;

an outer tube which surrounds the circumference of the finger fitting part and is open at an upper side thereof;

an elastic support part which is fixed to an inner surface of the finger fitting part, is elastically deformed when a finger is fitted into the fitting space, and is then restored to its original shape when the finger is removed therefrom;

a stick extending downward from one point of the inner space of the outer tube; and a brush provided on an end portion of the stick to be usable for dipping and applying of the cosmetic material.

2. The finger fitting-type makeup tool of claim 1, wherein the elastic support part is formed of any one material among polyurethane foam, memory foam, latex, sponge, natural rubber, elastomer, urethane rubber, nitrile-butadiene rubber (NBR), silicone.

3. The finger fitting-type makeup tool of claim 1, wherein the elastic support part is formed so as to close a mouth portion of the finger fitting part.

4. The finger fitting-type makeup tool of claim 1, wherein the elastic support part is provided in plural along a circumference of the finger fitting part.

5. The finger fitting-type makeup tool of claim 4, wherein each of the elastic support parts is formed so as to surface contact with the adjacent elastic support part to close the mouth portion of the finger fitting part.

6. The finger fitting-type makeup tool of claim 5, wherein the elastic support part has a basic state where it is deformed in a state where no finger is fitted thereinto.

7. The finger fitting-type makeup tool of claim 1, wherein the elastic support part has a basic state where it is deformed in a state where no finger is fitted thereinto.

8. The finger fitting-type makeup tool of claim 1, wherein the middle unit includes, a base provided between the container and the outer tube, and provided with a penetration hole through which the stick and the brush pass; and an upper rib which is extended to an upper side of the base to be inserted into a space between the finger fitting part and the outer tube, and wherein a first catching protrusion is formed on any one of an inner surface of the outer tube and an outer surface of the upper rib, a second catching protrusion is formed on another one of the inner surface of the outer tube and the outer surface of the upper rib, and the application unit is fixed to the middle unit by means of elastic coupling of the first catching protrusion and the second catching protrusion, and is separated from the middle unit by means of release of the elastic coupling.

9. The finger fitting-type makeup tool of claim 8, wherein a plurality of sliding ribs is provided around the stick, and a guide is formed on an inner surface of the upper rib, the guide having a plurality of convex parts providing a guide surface which guides movement of the sliding rib, and which the sliding rib slides on, at a time of the coupling of the application unit.

10. The finger fitting-type makeup tool of claim 9, wherein when the application unit is fixed to the middle unit, the sliding rib slides along the guide and the outer tube is rotated, so that the first catching protrusion slides obliquely over the second catching protrusion to be elastically coupled to the second catching protrusion.

11. The finger fitting-type makeup tool of claim 9, wherein when the application unit is separated from the middle unit, the sliding rib slides along the guide and the outer tube is rotated, so that the first catching protrusion slides obliquely over the second catching protrusion to release the elastic coupling with the second catching protrusion.

12. The finger fitting-type makeup tool of claim 9, wherein the outer tube is formed so as to have a height equal to or lower than an end portion of the sliding rib.

13. The finger fitting-type makeup tool of claim 9, wherein the sliding rib has a plate shape extended lengthily downward, and is fixed to the finger fitting part and the stick, wherein between the sliding rib and the outer tube, there is provided a space into which the upper rib can be inserted, and wherein in a state where the application unit is coupled to the middle unit, the sliding rib is spaced apart from the inner surface of the upper rib.

14. The finger fitting-type makeup tool of claim 9, wherein the elastic support part has a basic state where it is deformed in a state where no finger is fitted thereinto.

15. The finger fitting-type makeup tool of claim 8, wherein the application unit is provided so as to be rotated by rotation of a finger fitted into the finger fitting part and the elastic support part.

16. The finger fitting-type makeup tool of claim 8, wherein the first catching protrusion is provided on the inner surface of the outer tube, and the second catching protrusion is provided on the outer surface of the upper rib.

17. The finger fitting-type makeup tool of claim 8, wherein the first catching protrusion is a plurality of protrusions, and the second catching protrusion is formed along the inner surface of the outer tube or the outer surface of the upper rib as a ring shape.

18. The finger fitting-type makeup tool of claim 8, wherein the elastic support part has a basic state where it is deformed in a state where no finger is fitted thereinto.

19. A finger fitting-type makeup tool, comprising:

a container in which an eyelash cosmetic material is received and which is open at an upper end thereof;

an application unit coupled to the upper side of the container and allowing a user to fit his/her finger thereinto to apply the cosmetic material; and a middle unit for detachably coupling the application unit to the container, wherein the application unit includes:

a finger fitting part which provides a fitting space into which the user can fit the finger from an upper side thereof;

an outer tube which surrounds the circumference of the finger fitting part and is open at an upper side thereof;

an elastic support part which is provided in the outer tube, and is elastically deformed to surround a finger fitted thereinto from above;

a stick extending downward from one point of the inner space of the outer tube; and a brush which is provided on an end portion of the stick and is capable of being coated with and applying the cosmetic material, wherein the middle unit includes:

a base provided between the container and the outer tube, and provided with a penetration hole through which the stick and the brush pass; and an upper rib which is extended to an upper side of the base to be inserted into a space between the finger fitting part and the outer tube, wherein a first catching protrusion is formed on any one of an inner surface of the outer tube and an outer surface of the upper rib, and a second catching protrusion is formed on another one of the inner surface of the outer tube and the outer surface of the upper rib, and wherein the application unit is fixed to the middle unit by means of elastic coupling of the first catching protrusion and the second catching protrusion, and is separated from the middle unit by means of release of the elastic coupling.

* * * * *